United States Patent [19]

Tse et al.

[11] Patent Number: 5,062,635

[45] Date of Patent: Nov. 5, 1991

[54] NUMBER GENERATING DEVICE WITH MAGNETIC BIASING MEANS

[76] Inventors: Kam Y. Tse; Leonard J. Wong, both of 63-75 Carlton St., Rego Park, N.Y. 11374

[21] Appl. No.: 384,793

[22] Filed: Jul. 25, 1989

[51] Int. Cl.[5] ..... A63B 71/00; A63F 1/18

[52] U.S. Cl. ..... 273/144 A; 273/144 B; 273/460

[58] Field of Search ..... 273/1 GD, 144 R, 144 A, 273/144 B, 142 JB, 138 A, 143 C, 141 A, 11 C, 1 M; 434/188

[56] References Cited

U.S. PATENT DOCUMENTS

| | | | |
|---|---|---|---|
| 2,237,122 | 3/1939 | Swan et al. | 273/138 A |
| 3,633,916 | 1/1972 | Thomas | 273/142 JB |
| 4,015,845 | 4/1977 | Sines | 273/11 C |
| 4,193,596 | 3/1980 | Baker | 273/11 C |
| 4,508,346 | 4/1985 | Salvucci | 273/144 B |
| 4,601,471 | 7/1988 | Frank | 273/144 A |
| 4,786,056 | 11/1988 | Donnigan | 273/144 A |
| 4,817,951 | 4/1989 | Crouch et al. | 273/138 A |
| 4,858,932 | 8/1989 | Keane | 273/138 A |
| 4,884,810 | 12/1989 | Tiyony | 273/144 B |

FOREIGN PATENT DOCUMENTS

| | | | |
|---|---|---|---|
| 0112686 | 7/1984 | European Pat. Off. | 273/11 C |

*Primary Examiner*—Edward M. Coven
*Assistant Examiner*—Dean Small
*Attorney, Agent, or Firm*—Terry M. Gernstein

[57] ABSTRACT

A device for generating numbers that can be used to play a numbers game includes a fan which forces number bearing balls from a chamber into an exit chute. The chute can be opened or closed using a disc-like valve. One embodiment of the device includes a magnetic biasing system attached to the chute entrance for influencing the selection process. The magnetic biasing systems uses a statistical analysis of previous winning numbers to generate a pattern of the winning numbers and to control the magnetic biasing to influence the selection process of each ball based upon any tendency for one number to repeatedly appear in a particular location within the winning number, if such tendency is found.

1 Claim, 3 Drawing Sheets

NUMBER GENERATING DEVICE WITH MAGNETIC BIASING MEANS

TECHNICAL FIELD OF THE INVENTION

The present invention relates to the general art of number generating, and to the particular field of selecting numbers from a set of numbers.

BACKGROUND OF THE INVENTION

Recent Years has seen an increase in state run lotto games as well as other such games that require a person to pick several numbers and determines a winner based on numbers that are apparently randomly generated. The payoffs to the winners of such games have become legendary. Many parlor games also require selection of numbers.

Because of this, more and more people are playing such number guessing games. One of the most stressful portions of such games is the selection of the number that will be used. Many people use a system based on their birthday, anniversary, telephone number or the like. While sometimes successful, since the winning numbers are supposed to be randomly generated, any selection that groups the numbers in this manner may not be entirely in consert with the game winning number selection process.

While the winning number selection process of the game coordinator is theoretically totally random, there have been times that certain patterns appear. For example, the first number may tend to be a number between "1" and "5" more often than a number that is greater than "5" for a certain period of time, and the like. It may increase a person's chances of winning if such pattern can be identified before the game organizers identify such pattern, or before it changes. Even if the pattern is changed, selection based on a pattern that is perceived based on the game itself is far better than a selection based on a birthday or the like that may have nothing to do with the selection process.

While there are random number generators available, see, for example, the random number generators disclosed in U.S. Pat. Nos. 4,508,346, 4,601,471 and 4,786,056, none of these devices is totally capable of "influencing" the random number generation based on a perceived pattern.

Therefore, there is a need for a device that can be used to select a number to play a lotto type-game or number selection-type game and which can be used to generate either a totally random selection of numbers or can be used to generate a selection of numbers that has been "influenced" in some patterned manner.

OBJECTS OF THE INVENTION

It is a main object of the present invention is to provide a device that can be used to select a number to play a lotto type-game or number selection-type game and which can be used to generate a totally random selection of numbers for use in entering such lotto-type game.

It is another object of the present invention is to provide a device that can be used to select a number to play a lotto type-game or number selection-type game and which can be used to generate a totally random selection of numbers for use in entering such lotto-type game and which can also be used to generate numbers according to a selection process that "influences" the selection of a generated number.

It is another object of the present invention is to provide a device that can be used to select a number to play a lotto type-game or number selection-type game and which can be used to generate a totally random selection of numbers for use in entering such lotto-type game and which can also be used to generate numbers according to a selection process that "influences" the selection of a generated number based on a program that spots trends in the winning number selection process.

SUMMARY OF THE INVENTION

These, and other, objects are achieved by a number generator device that generates numbers in a manner that is similar to the selection process of many lotto-type and number-type games. That is, numbers are placed on light, ping-pong type balls and blown out of a container.

The device further includes a means for influencing which balls are able to be blown out of the container. The influencing means is a pre-programmed microprocessor that can be programmed to use prior winning numbers to anticipate trends in the selection process of the game organizers and to influence the selection process of the device accordingly. The program is set in the processor by the manufacturer according to a statistical and/or a data fitting analysis, and the only input required of the user is the winning numbers from the past several games.

In this manner, the device can be used to generate entirely random numbers if so desired, or it can be used to generate numbers that have been selected according to an influencing program based on a pattern of prior winning numbers.

DETAILED DESCRIPTION OF THE PREFERRED EMBODIMENT OF THE INVENTION

Figure 1:
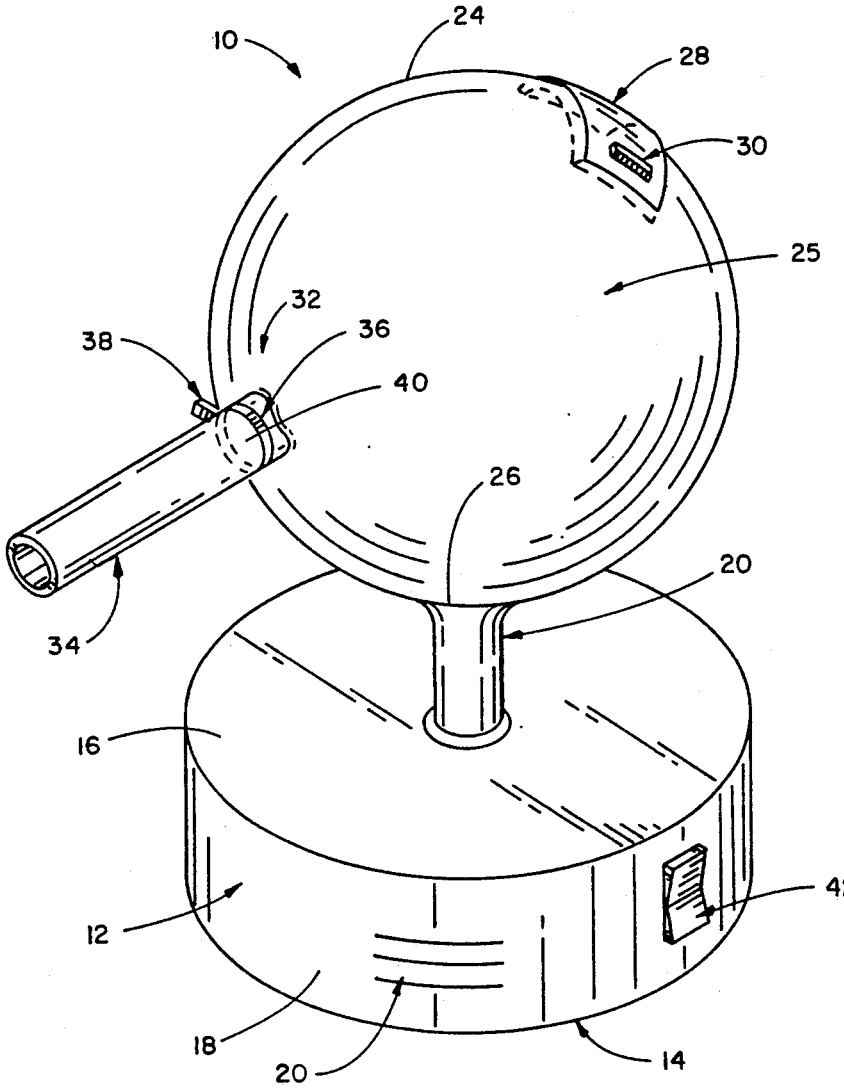
FIG. 1 is a perspective view of a first embodiment of the device embodying the present invention.

Shown in FIG. 1 is a number selection device 10 that is capable of generating numbers on a random basis. The device 10 includes a cylindrical base 12 having a bottom 14 and a top 16 connected by a wall 18. The base 12 is hollow and has a battery operated fan unit housed therein. The fan unit includes a fan such as disclosed in U.S. Pat. No. 4,786,056 (the disclosure of which is incorporated herein by reference), and the fan is oriented to direct air upwards into an updraft channel 20. Air intake vents 22 are defined on the wall 18 whereby ambient air is drawn into the housing for re-direction into the updraft channel by the fan. If suitable, the fan unit can be powered from utility power via a cord. The exact details of the fan will not be presented herein since such details are fully disclosed in the incorporated patent, especially in FIGS. 3–6 and the associated text. The only modification to the incorporated patent device is that the air is directed into the updraft channel in the device 10 rather than the direction of the air as shown in the incorporated patent. Any other required modifications will be evident to those skilled in the art based on the present disclosure.

A spherical body 24 is hollow to define a ball containing chamber 25, and is supported on top of the updraft channel. The body 25 is preferably translucent and includes an air entrance 26 located to permit air from the fan unit to flow into the chamber 24 and a ball entry door 28 having a handle 30 thereon and being hinged to the body 24 to open and to close an entryway through which the numbered balls (to be described below) used in the device 10 are inserted into the hollow chamber 24. A ball exitway 32 is also defined in the body 24, and is connected to a ball chute 34 through which balls are discharged from the chamber. The chute is shown in FIG. 1 as being horizontally oriented; however, it could be angled downwardly if desired.

A control gate 36 is located in the chute, and is hand operable using a handle 38 to open and close the chute and thereby control the movement of balls from the chamber 25 into the chute 34. The control gate includes a butterfly valve type device having a disc-like body 40 pivotally mounted on the chute to be rotated by rotation of the handle 38.

An on/off switch 42 is mounted on the wall 18 and connects the fan unit to the power source when the switch is in the "on" position.

Figure 2:
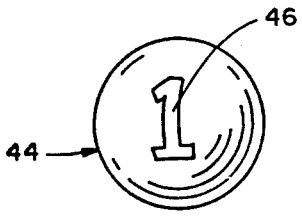
FIG. 2 is a perspective view of a ball used with the device of the present invention.

The chamber is filled with a multiplicity of balls 44, such as shown in FIG. 2. Each ball has a number, such as number 46, imprinted thereon. The numbers 46 include the numbers used in the number games, such as numbers 1–10 inclusively. Other indicia can also be imprinted on the ball if suitable.

In operation of the device 10, a multiplicity of numbered balls 44 are inserted into the chamber 25 via the entryway, an the on/off switch placed into the "on" position after closing the entryway door. The exit chute 34 is opened by manipulating the handle 38, and the air flowing from the fan unit will circulate within the chamber before exiting that chamber via the chute 34. The exiting air will tend to pull balls out of the chamber an into the chute 34. As each ball exits the chamber, it is placed in an appropriate location. The number of balls that is used is determined by the number of digits used in the particular numbers game being played, and the process is repeated until a complete number is achieved. This complete number is the number that will be entered by the user of the device 10. The entering number can be formed in any suitable manner using the balls 44 to provide the digits of the number. The digits can be formed in the sequence that the balls are discharged from the chamber, or in a reverse order or the like.

The device 10 generates number digits on a random basis. However, it has often been observed that some number games have a pattern on some digits for at least a short time. It would be to the advantage of an entrant to identify such a pattern, and then be able to "influence" the selection of digits for the entering number according to the same pattern. Even if the pattern is not accurate, or has been identified and changed by the game operator, the entrant is in no worse position than if random digits are selected.

Accordingly, the present invention contemplates a number generator that can be programmed to "influence" the numbers generated for use as the digits of the entering number.

Such a device is shown in FIGS. 3–7 as device 10'. Device 10' is similar to device 10, and thus similar reference numerals are used to identify similar elements. However, device 10' includes a system for influencing which balls are discharged through the chute 34. This system includes an annular magnet 50 surrounding exit port 52 from the chamber 25, and an annular shutter-like closure device 54 surrounding that same exit port and being located within the annular magnet. A ball sensor device 56 is located on the chute 34 downstream with respect to ball movement from the exit port 52.

Operation of the magnet 50 and the closure device 54 are controlled by a microprocessor as will be discussed below.

Figure 4:
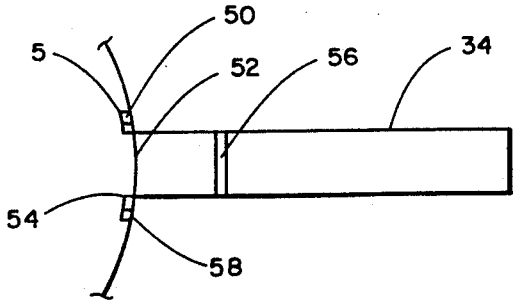
FIG. 4 is a side elevational view of the escape chute for the balls in the FIG. 3 device.
Figure 3:
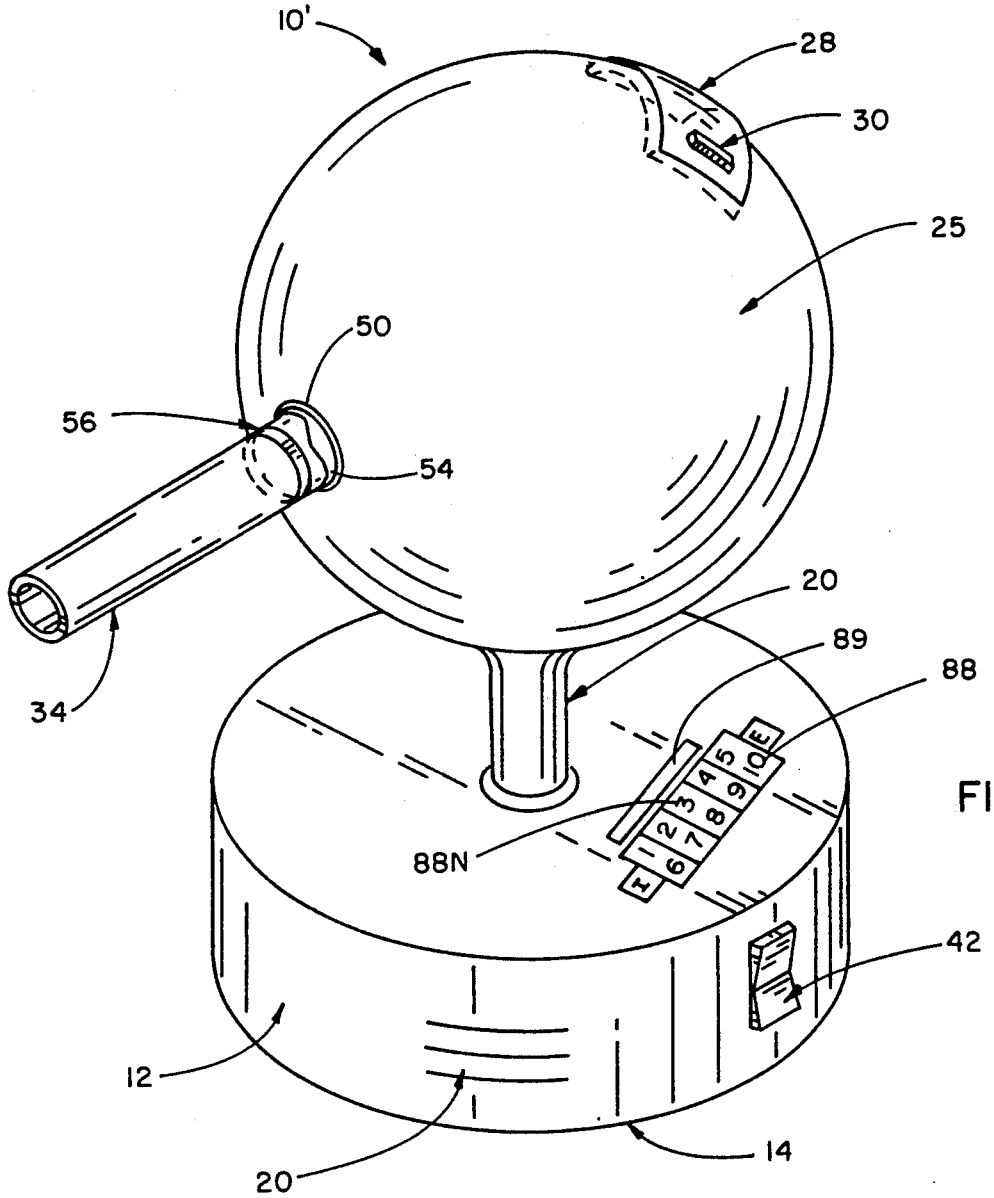
FIG. 3 is a perspective view of a second embodiment of the device of the present invention.

The magnet 50 is an electromagnet that is connected to the power source via leads, such as lead 58 and via the on/off switch 42 and to the microprocessor so that power to the magnet can be controlled by that microprocessor. The magnet is designed to be a single pole magnet, such as south as indicated in FIG. 4. The device 10' includes a multiplicity of balls 44' and 44" each having a number 46 imprinted thereon, and which includes a magnet strip 60 and 62 mounted on balls 44' and 44" respectively. The strip 60 is divided into two semicircles 60*a* and 60*b*, one of which is the north pole and one of which is the south pole of a magnet; whereas, the magnet strip 62 is entirely one pole, which pole is the opposite pole to the pole of the magnet 50, in this case, the magnet strip 62 is the north pole.

The balls 44' all contain the digits from "1" to "5" and the balls 44" contain the digits from "6" to "10". Thus, if the magnet 50 is activated, the south pole of that magnet will attract the north poles of the balls and repel the south poles of the balls 44'. In this manner, the balls 44", having the digits "6" to "10" thereon will be slightly more attracted to the exit port 52 than will the balls 44' having the numbers from "1" to "5" thereon. Thus, turning on the magnet 50 slightly influences the selection process by slightly biasing the selection towards the high numbers. The magnet can be biased using appropriate circuitry to have the single pole characteristics described above. Such circuitry can include appropriate current converters, current controllers and the like.

To influence the selection process towards the low numbers, that is the numbers from "1" to "5", the device 10' includes a size selector means. This size selector means includes the shutter device 54 and the size of the balls.

Figure 5A:
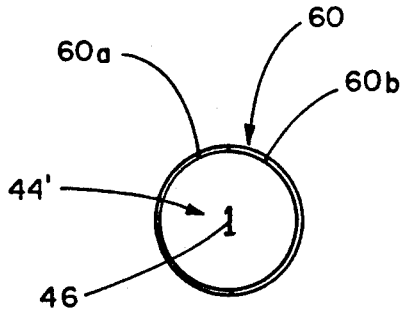
FIGS. 5A and 5B are perspective views of balls used in the second embodiment of the present invention.
Figure 5B:
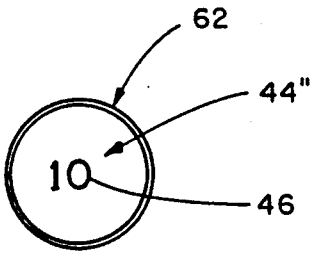

By comparing FIGS. 5A and 5B, it is seen that balls 44" are slightly larger than the balls 44'. Thus, if the size of exit port 52 is decreased, the balls 44" will not be as likely to pass through such port as will the balls 44' since the balls 44' are smaller. Whereas, if the port is large enough for the balls 44" to pass freely therethrough, the balls 44' will still have a better chance of passing therethrough.

The sizing of the exit port is thus used in conjunction with the magnet 50 to influence the selection process. By appropriately sizing the exit port when the magnet 50 is either on or off, the selection process is influenced toward either high or low numbers. It is noted that other combinations can be used to refine the selection influencing process even further than simply the high or the low numbers discussed above without departing from the scope of the present invention.

The port shutter device is similar to the shutter used in a camera, and is indicated in FIGS. 6A through 6D. The shutter includes a plurality of thin steel shutter leaves, such as leaf 70, which rotate about a pivot 72 in such a way that they open out in a direction away from the longitudinal axis of the chute 34, i.e., away from the center of the chute outwards, and then, on completion of the selection, can be moved back toward a closed condition. The shutter can include appropriate cocking springs.

Figure 6A:
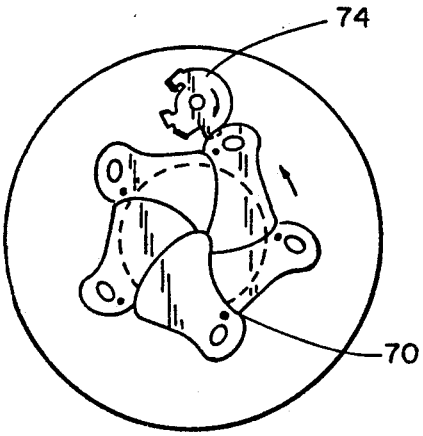
FIGS. 6A–6D show a device used to close the escape chute entrance in order to influence the selection of the balls by the device.
Figure 6B:
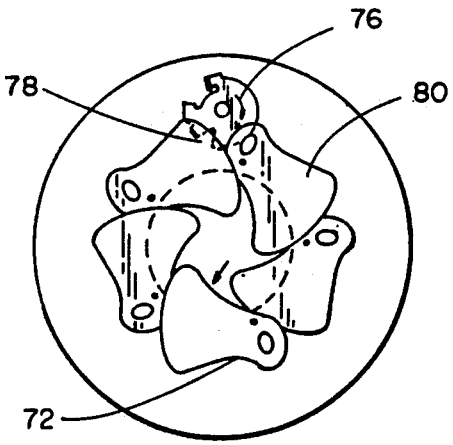
Figure 6C:
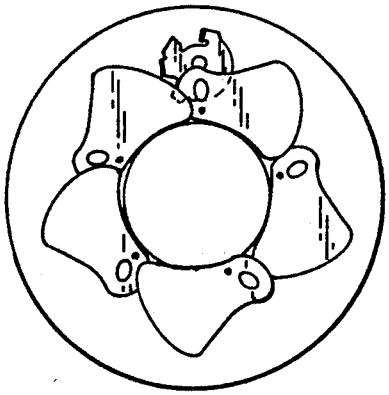
Figure 6D:
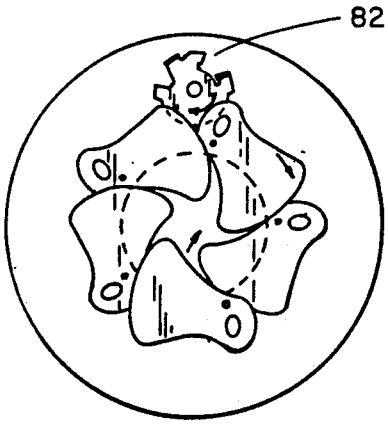

As shown in FIGS. 6A–6D, with reference to a single leaf, as shown in FIG. 6A, the shutter is closed. The unit includes a drive element 74 which is operated by the microprocessor as will be discussed below. When the drive element 74 operates, it rotates in the direction of arrow 76 and thrusts against the shutter operating pins, such as pin 78 of actuating ring 80, causing that ring to rotate counter clockwise as viewed from above FIG. 6B. Other pins mounted on the ring engage with slots in the shutter leaves and cause these leaves to swing about their respective pivots. In FIG. 6C, the shutter is fully opened. Further rotation of the drive element can be prevented by an escapement mechanism. When the shutter is to be closed, the drive element is permitted to continue its rotation by having the microprocessor release the escapement mechanism. A projection on the drive element now thrusts against shutter-closing pin 82 on the actuating ring and causes the ring to rotate in the reverse direction so that the shutter leaves close again. The amount of opening and closing can be adjusted using the above-described elements.

Of course, other simpler shutter mechanisms can be used without departing from the scope of the present disclosure. For example a simple constricting mechanism can be used in which an annular ring is simply constricted by a screw-type turnbuckle control with the gears and a gear reducing mechanism being connected to a motor mounted in the housing and controlled by the microprocessor.

By adjusting the amount with which the port 52 is opened, the selection of either balls 44′ or 44″ can be slightly biased.

The ball sensor mechanism 56 is a strip of material that is sensitive to the magnetic fields associated with the balls. As the field of one of the balls passes the strip of the sensor 56, a signal is generated using a system that is well known, such as used in counters or the like. This signal is relayed to the microprocessor to indicate that a selection has been made, and to begin to bias the magnet 50 and/or the shutter to influence the selection of the next digit in the number.

The microprocessor is programmed according to any well known technique, such as described in texts such as *An Introduction to Microcomputers,* by Raymond A. Nelli, published by Adam Osborne and Associates; *Foundations of Microprogramming,* by A. K. Agrawala and T. G. Raushcer, published by Academic Press Inc, *Microprogramming Principles and Practice,* by S. S. Husson, published by Prentice-Hall, Inc of Englewood Cliffs, N.J., or *Designing with Microprocessors,* by D. L. Cannon, et al, published by Texas Instruments, Inc of Dallas, Tex., and the materials disclosed in the bibliographies thereof.

The programs can be designed according to any well known technique of data analysis, such as disclosed in standard texts, such as *Statistical Treatment of Experimental Data,* by Hugh D. Young, published by McGraw-Hill Book Company, or *Statistical Adjustment of Data,* by W. Edwards Deming, published by Dover Publications, Inc of N.Y., and *A First Course in Numerical Analysis,* by Anthony Ralston, published by McGraw-Hill Book Company. The disclosures of the above-mentioned texts are incorporated herein by reference.

The microprocessor is stored in the housing 12, and raw data in the form of previous winning number combinations is fed into the microprocessor via a keyboard 88 having number keys 88N, an error key E and an input key I. A readout 89 is also included. The program in the microprocessor then evaluates such data, and seeks a tendency for the digits of each number. For example, if the numbers of the particular game being analyzed consist of three digits, the program seeks a tendency for high numbers or for low numbers on the first digit, for the same tendency on the second number and for a tendency on the third digit.

Figure 7:
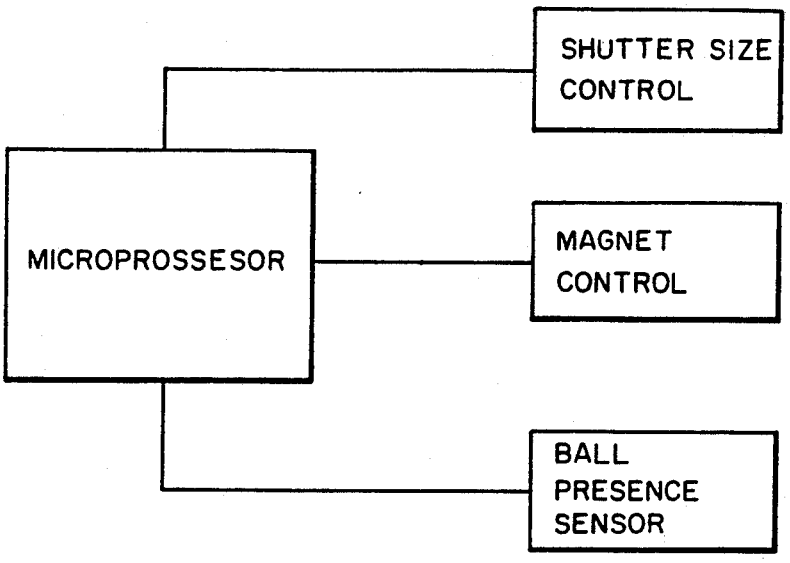
FIG. 7 is a schematic of a circuit using a microprocessor to control the selection process by the device to account for any possible patterns in previous winning numbers.

Once such tendency is found, the magnet and the shutter are biased accordingly to influence a selection for the first digit based on the tendency found by the program. As soon as the ball sensor 56 signals that a ball has been selected, the microprocessor controls the magnet and the shutter again to influence the selection of the second ball bearing the second digit of the selected number according to the bias found in the program. The process is repeated until the entire number is selected. This process is schematically indicated in FIG. 7.

If no bias is detected, the magnet and the shutter are placed in a position to offset each other so that all numbers will be equally likely to be selected to default to a random selection process again.

It is understood that while certain forms of the present invention have been illustrated and described herein, it is not to be limited to the specific forms or arrangements of parts described and shown.

I claim:

1. A number generator for use in generating lottery numbers comprising:

A) a base having a cylindrical wall with air inlet vents defined therein, and a bottom;

B) an updraft channel mounted on said base;

C) a spherical container mounted on said channel, said container having a chamber defined interiorly thereof, said chamber being fluidically connected to said channel to receive air therefrom;

D) an inlet opening defined in said container;

E) a door hingeably mounted on said container to open and close said inlet opening;

F) an outlet chute connected to said container to be fluidically connected to said chamber, said chute having a longitudinal axis;

G) a multiplicity of balls, each having a number thereon, said balls being of different sizes with balls having numbers 1 through 5 thereon being smaller than balls having numbers 6 through 0 thereon, said balls being combined in said chute to form a series of number; and H) selection means for selecting one ball over another, said selection means including (1) a fan mounted in said housing and oriented to force air from said housing into said updraft channel towards said chamber, (2) power means for operating said selection means, (3) switch means connecting said fan to said power means and for controlling operation of said fan by selectively connecting and disconnecting said fan and said power means, and (4) chute covering means on said chute to selectively open and close said chute to said chamber, said chute covering means including a butterfly disc rotatably mounted in said chute and a handle connected to said disc and extending outside said chute; and (I) influencing means for biasing the selection of one ball over another to move into said chute, said influencing means including (1) a magnet on each ball, each magnet being oriented so that only a single pole thereof faces outwardly of each ball, (2) an electromagnet mounted adjacent to said chute, said electromagnet being connected to a source of power and being turned on and off to influence said ball mounted magnets when said electromagnet is turned on.

(3) a programmed microprocessor means for controlling said electromagnet and a shutter means according to a program stored in said microprocessor means, (4) said shutter means mounted adjacent to said chute and adjacent to said electromagnet and being opened and closed to permit selected ones of said balls to move into said chute, said shutter means including (a) a plurality of steel shutter leaves each of which includes a pivot about which it rotates in such a way as to open said shutter means when said shutter leaves move out in a direction away from said chute longitudinal axis and to close said shutter means when said shutter leaves are moved back toward said chute longitudinal axis, (b) a drive element connected to said microprocessor means to be connected by said microprocessor means to a source of power to operate said shutter leaves according to the program stored in said microprocessor means, (c) shutter operating pins engaged against said drive element, (d) an actuating ring connected to said operating pins, said actuating ring including a plurality of slots, (e) shutter closing pins on said actuating ring in position to engage against said drive element to close said shutter, and (e) a ball sensor mounted in said chute.

* * * * *